US012390031B1

(12) United States Patent
Wang

(10) Patent No.: US 12,390,031 B1
(45) Date of Patent: Aug. 19, 2025

(54) PILLOW

(71) Applicant: GUANGZHOU LIKEGAO IMPORT & EXPORT CO., LTD, Guangzhou (CN)

(72) Inventor: Bizhong Wang, Guangzhou (CN)

(73) Assignee: GUANGZHOU LIKEGAO IMPORT & EXPORT CO., LTD, Guangzhou (CN)

( * ) Notice: Subject to any disclaimer, the term of this patent is extended or adjusted under 35 U.S.C. 154(b) by 0 days.

(21) Appl. No.: 18/830,338

(22) Filed: Sep. 10, 2024

(51) Int. Cl.
*A47G 9/10* (2006.01)

(52) U.S. Cl.
CPC ..... *A47G 9/1009* (2013.01); *A47G 9/1081* (2013.01)

(58) Field of Classification Search
CPC ..... A47G 9/10; A47G 9/1081; A47G 9/109; A47G 2009/1018; A47G 2009/0253
See application file for complete search history.

(56) References Cited

U.S. PATENT DOCUMENTS 4,118,813 A * 10/1978 Armstrong ..... A47G 9/10 5/636
5,084,928 A * 2/1992 Skillington ..... A47G 9/0253 5/490
5,533,218 A * 7/1996 Fahy ..... A47C 27/16 5/636
6,345,401 B1 * 2/2002 Frydman ..... A47G 9/109 5/636
7,594,288 B1 * 9/2009 Holliday ..... A47G 9/109 5/636
11,116,327 B2 * 9/2021 Choi ..... A47C 21/048
2005/0278852 A1 * 12/2005 Wahrmund ..... A47G 9/10 5/636
2006/0288491 A1 * 12/2006 Mikkelsen ..... A47C 27/15 5/740
2007/0251013 A1 * 11/2007 Borror ..... A01K 1/0353 5/652
2008/0263767 A1 * 10/2008 Mooney ..... A47G 9/0253 5/490

(Continued)

FOREIGN PATENT DOCUMENTS

CN 106923584 A * 7/2017 ..... A47G 9/0253
WO WO-2010075294 A1 * 7/2010 ..... A47G 9/10

OTHER PUBLICATIONS

Wikipedia, Date Accessed: Jan. 31, 2025, "Brinnell hardness test", https://en.wikipedia.org/wiki/Brinell_hardness_test.*
ASTM D3574-17 (Year: 2017).*

*Primary Examiner* — Eric J Kurilla

(57) ABSTRACT

A pillow includes a pillow core main body. The pillow core main body includes a contact layer and a support layer. The contact layer and the support layer are stacked and connected. A hardness of the support layer is greater than a hardness of the contact layer. Through the above structure, when the pillow core main body is placed on a soft mattress, due to the high hardness of the support layer, the pillow core main body is provided with good support, and the pillow core main body will not collapse under the support of the support layer. Moreover, due to the good softness of the contact layer, a user can have a comfortable experience when resting on the contact layer. The stacked arrangement of the contact layer and the support layer not only provides sufficient support for the pillow, but also gives the user a comfortable sleeping experience.

11 Claims, 7 Drawing Sheets

(56) References Cited

U.S. PATENT DOCUMENTS

| | | | | |
|---|---|---|---|---|
| 2011/0094033 | A1* | 4/2011 | Lee | A47G 9/109 5/636 |
| 2011/0289689 | A1* | 12/2011 | Mikkelsen | A47G 9/109 5/655.9 |

* cited by examiner

PILLOW

TECHNICAL FIELD

The present invention relates to the field of pillows, particularly to a pillow.

BACKGROUND ART

Sleep pillow products not only have a significant impact on sleep quality, but also greatly affect shoulder and neck health. Sleep pillows mainly support the neck and head during sleep, assisting in maintaining the natural and healthy curvature of the cervical spine.

In the existing sleep pillows, in order to pursue the softness and comfort of the pillow, the support of the pillow is made insufficient. When the pillow is placed on a soft mattress, it is easy for the pillow to concave downwards with the mattress, resulting in the pillow not providing good support for a user's head and neck, and even causing damage to the cervical spine.

SUMMARY

In order to overcome the shortcomings of the prior art, a pillow is provided to provide a good support effect while satisfying the softness of the pillow, greatly improving the user's experience.

The technical solution adopted by the present invention to solve its technical problem is as follows.

A pillow is provided, including a pillow core main body. The pillow core main body includes a contact layer and a support layer. The contact layer and the support layer are stacked and connected, and a hardness of the support layer is greater than a hardness of the contact layer.

As an improvement of the present invention, the support layer is integrally formed, and the contact layer is integrally formed. The support layer is connected to the contact layer through a connection part in a stacked manner.

As an improvement of the present invention, the support layer is integrally formed by molding, and the contact layer is integrally formed by molding. When the contact layer is integrally formed by molding, at least one part of the contact layer covers a surface of the support layer to form the connection part.

As an improvement of the present invention, the support layer is provided with a first top surface, a first bottom surface, and a peripheral side surface. The first top surface and the first bottom surface are disposed opposite to each other, and the peripheral side surface is connected to the first top surface and the first bottom surface. When the contact layer is integrally formed by molding, the contact layer covers the first top surface.

As an improvement of the present invention, the support layer is provided with a first top surface, a first bottom surface, and a peripheral side surface. The first top surface and the first bottom surface are disposed opposite to each other. The peripheral side surface is connected to the first top surface and the first bottom surface. When the contact layer is integrally formed by molding, the contact layer covers the first top surface and the peripheral side surface.

As an improvement of the present invention, a melting point of the support layer is greater than a melting point of the contact layer.

As an improvement of the present invention, a density of the contact layer is greater than a density of the support layer.

As an improvement of the present invention, a first height is provided between the first top surface and the first bottom surface. The pillow core main body is provided with a second top surface and a second bottom surface. The second top surface and the second bottom surface are arranged opposite to each other. A second height is provided between the first top surface and the second top surface, and the second height is greater than the first height.

As an improvement of the present invention, a range of the first height between the first top surface and the first bottom surface is 0.1-20 mm. A range of a third height between the second top surface and the second bottom surface is 120-140 mm.

As an improvement of the present invention, a density range of the contact layer is 70-90 D. A density range of the support layer is 50-70 D.

As an improvement of the present invention, Brinell hardness test is performed on the pillow core main body: when a force of 2.700 kgf is applied to the pillow core main body, a deformation of the pillow core main body is 25%; when a force of 3.520 kgf is applied to the pillow core main body, the deformation of the pillow core main body is 40%; and when a force of 5.060 kgf is applied to the pillow core main body, the deformation of the pillow core main body is 65%.

As an improvement of the present invention, a ratio of a force value at which the pillow core main body is compressed to 25% of an original thickness thereof to a force value at which the pillow core main body is compressed to 40% of the original thickness is 0.767. A ratio of a force value at which the pillow core main body is compressed to 65% of the original thickness to a force value at which the pillow core main body is compressed to 40% of the original thickness is 1.437.

As an improvement of the present invention, the pillow core main body is provided with a second top surface and a second bottom surface. The second top surface and the second bottom surface are arranged opposite to each other. A middle portion of the second top surface is provided with a first arc-shaped depression that is recessed from the first top surface towards the second bottom surface.

As an improvement of the present invention, the pillow core main body is equipped with a front side surface, a rear side surface, a left side surface and a right side surface. The front side surface and the rear side surface are connected to the second top surface and the second bottom surface, and are arranged opposite to each other. The left side surface and the right side surface are connected to the front side surface and the rear side surface, and are arranged opposite to each other. One end of the pillow core main body near the front side surface is protruded with a first side pillow part and a second side pillow part. The first side pillow part and the second side pillow part are symmetrically arranged at a left end and a right end of the pillow core main body.

As an improvement of the present invention, the first side pillow part and the second side pillow part surround and form a recessed neck receiving groove. A maximum depth range of the neck receiving groove is 40-60 mm.

As an improvement of the present invention, the pillow further includes a pillowcase. The pillowcase is at least partially sleeved on an outer surface of the pillow core main body, and a shape of the pillowcase is adapted to the pillow core main body. The pillowcase includes a third top surface and a third bottom surface. The third top surface and the third bottom surface are arranged opposite to each other. The third bottom surface is provided with a pillowcase opening, and the pillowcase can be sleeved on the outer surface of the pillow core main body through the pillowcase opening. The pillowcase opening is surrounded by an elastic strap. The elastic strap is connected to an edge of the pillowcase opening. The elastic strap is configured for shrinking the pillowcase opening.

As an improvement of the present invention, the pillowcase includes knitted fabric, ice silk fabric, nylon, and spandex.

A method for making a pillow is further provided, including:

Providing a first molding body and a first mold, wherein the first molding body is injected into the first mold and solidified to form a support layer;

Providing a second mold, wherein the support layer is taken out of the first mold and put into the second mold;

Providing a second molding body, wherein the second molding body is injected into the second mold, at least one part of the second molding body is attached to a surface of the support layer to form an attachment part, the second molding body solidifies to form a contact layer, the attachment part solidifies to form a connection part, and the contact layer is connected with the support layer through the connection part, so that the contact layer wraps the support layer;

Removing the contact layer and the support layer from the second mold to obtain the pillow.

As an improvement of the present invention, the support layer is provided with a first top surface, a first bottom surface, and a peripheral side surface. The first top surface and the first bottom surface are arranged opposite to each other. The peripheral side surface is connected to the first top surface and the first bottom surface. When the second molding body is injected into the second mold, the second molding body is attached to the first top surface.

As an improvement of the present invention, the support layer is provided with a first top surface, a first bottom surface, and a peripheral side surface. The first top surface and the first bottom surface are arranged opposite to each other. The peripheral side surface is connected to the first top surface and the first bottom surface. When the second molding body is injected into the second mold, the contact layer covers the first top surface and the peripheral side surface.

Beneficial effects of the present invention are as follows. The pillow is provided, including the pillow core main body. The pillow core main body includes the contact layer and the support layer. The contact layer and the support layer are stacked and connected, and the hardness of the support layer is greater than the hardness of the contact layer. Through the above structure, when the pillow core main body is placed on a soft mattress, due to the high hardness of the support layer, the pillow core main body is provided with good support, and the pillow core main body will not collapse under the support of the support layer. Moreover, due to the good softness of the contact layer, a user can have a comfortable experience when resting on the contact layer. The stacked arrangement of the contact layer and the support layer not only provides sufficient support for the pillow, but also gives the user a comfortable sleeping experience.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
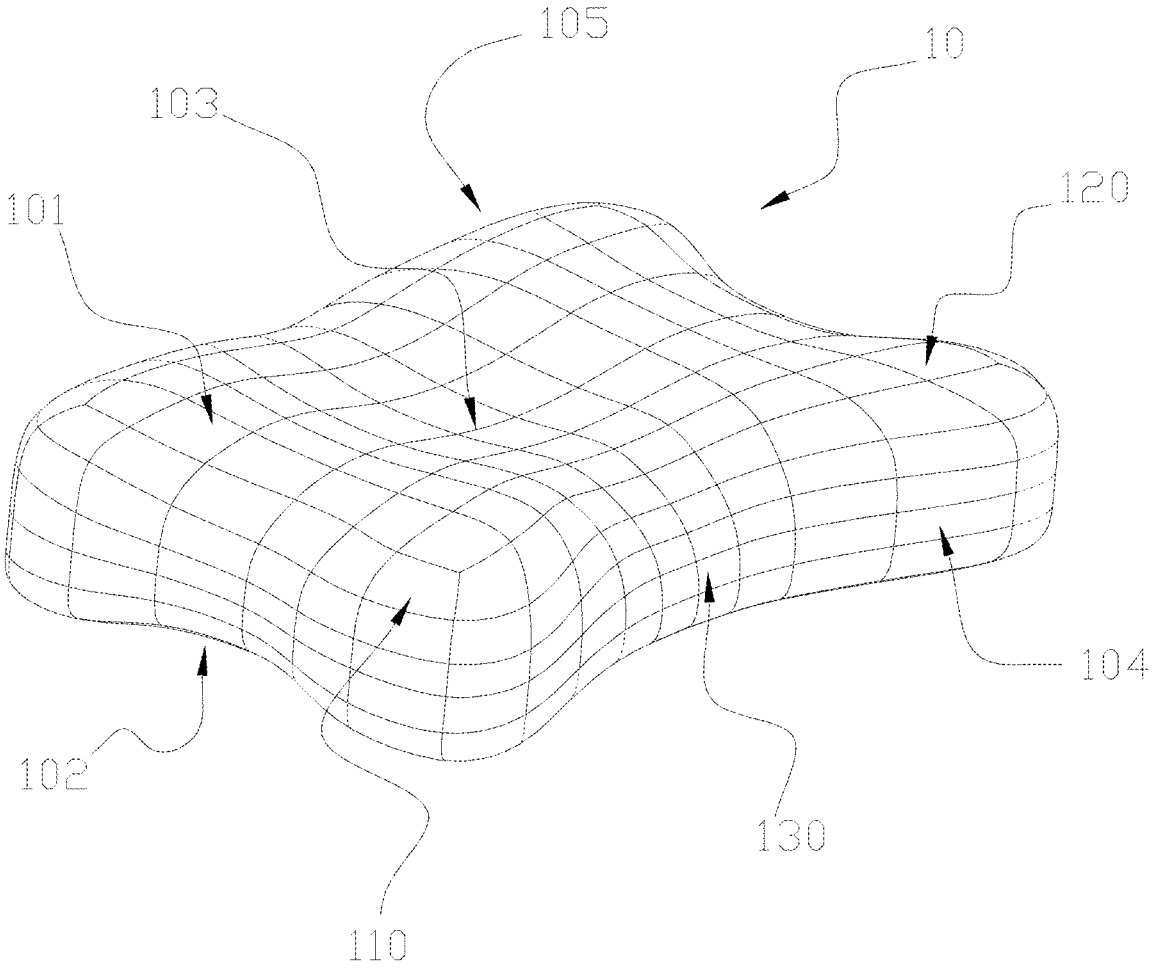
FIG. 1 is a schematic diagram of an overall structure of the pillow core main body of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
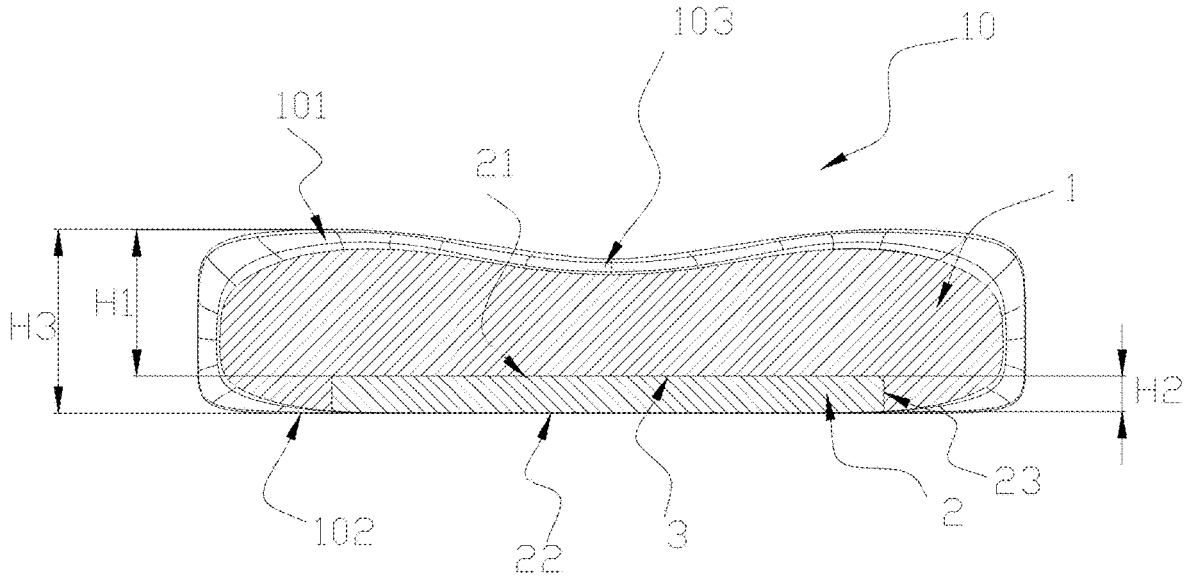
FIG. 2 is a sectional view of a pillow core main body cut along a left side surface and a right side surface of the present invention.
Figure 3:
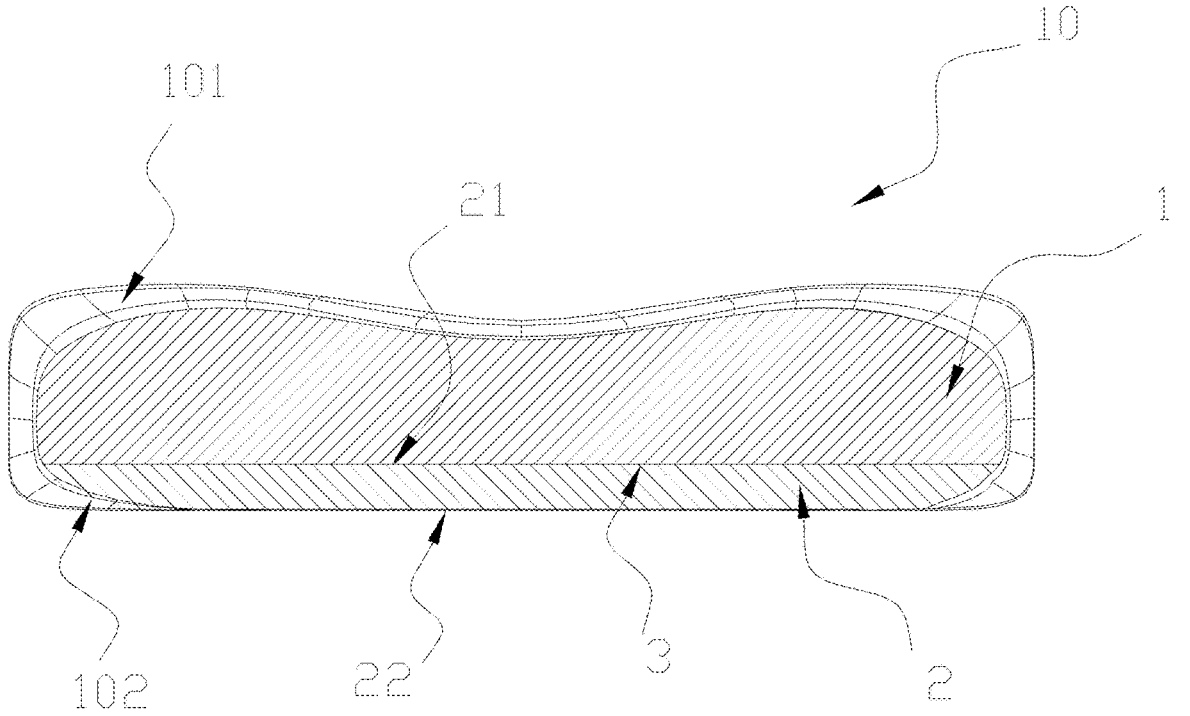
FIG. 3 is a sectional view of a pillow core main body cut along a left side surface and a right side surface in another embodiment of the present invention.
Figure 4:
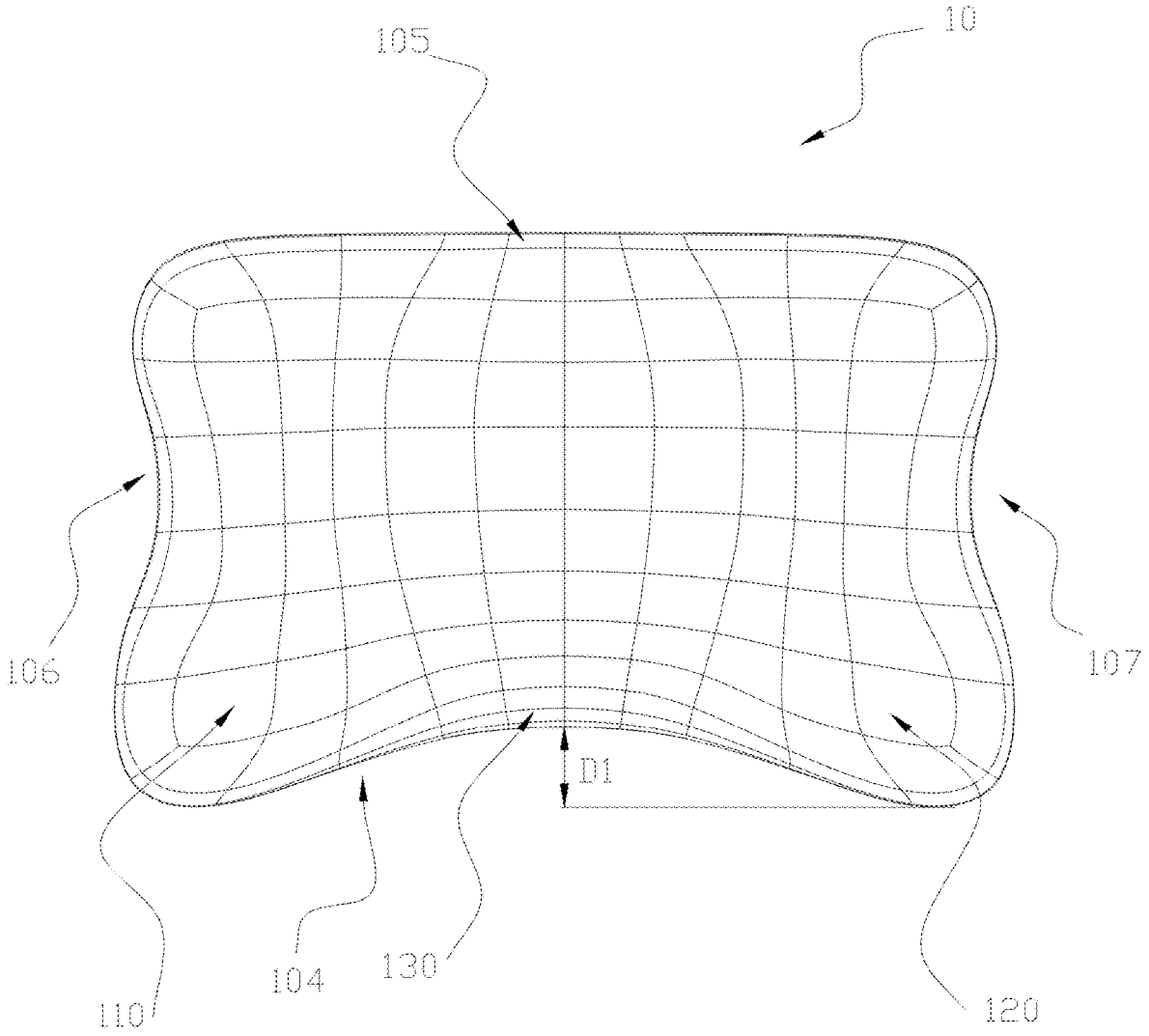
FIG. 4 is a top view of a pillow core main body of the present invention.
Figure 5:
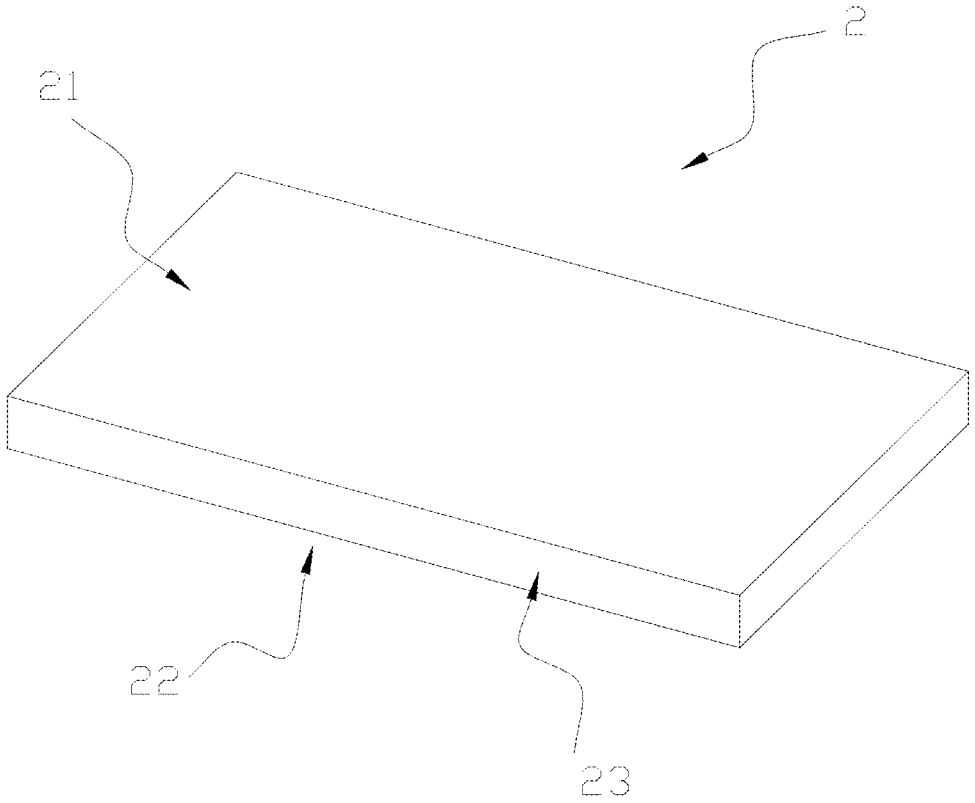
FIG. 5 is a schematic diagram of a structure of a support layer of the present invention.
Figure 6:
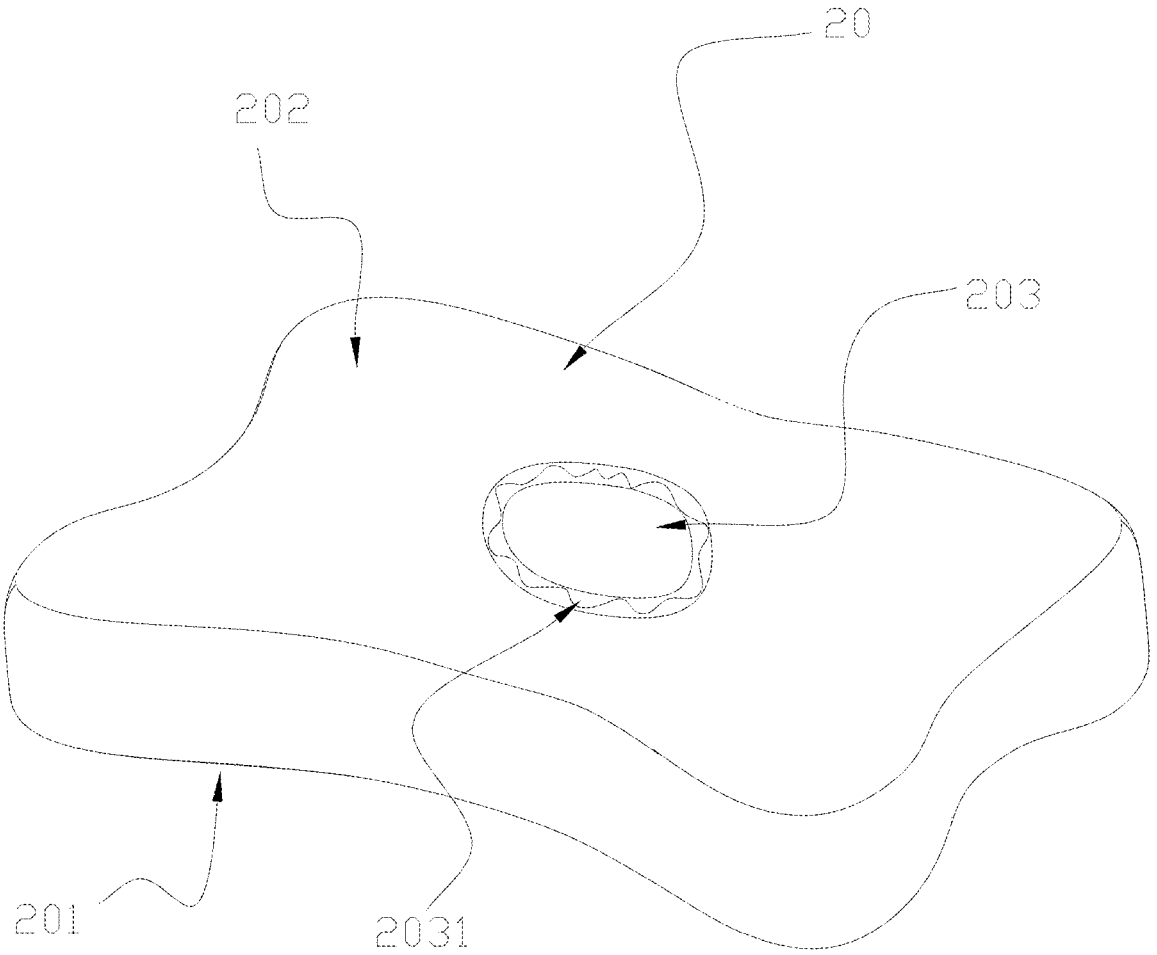
FIG. 6 is a schematic diagram of a structure of a pillowcase of the present invention.

Referring to FIGS. 1-6, a pillow includes a pillow core main body 10. The pillow core main body 10 includes a contact layer 1 and a support layer 2. The contact layer 1 and the support layer 2 are stacked and connected, and a hardness of the support layer 2 is greater than a hardness of the contact layer 1. Through the above structure, when the pillow core main body 10 is placed on a soft mattress, due to the high hardness of the support layer 2, the pillow core main body 10 is provided with good support, and the pillow core main body 10 will not collapse under the support of the support layer 2. Moreover, due to the good softness of the contact layer 1, a user can have a comfortable experience when resting on the contact layer 1. The stacked arrangement of the contact layer 1 and the support layer 2 not only provides sufficient support for the pillow, but also gives the user a comfortable sleeping experience.

In this embodiment, the support layer 2 is integrally formed, and the contact layer 1 is integrally formed. The support layer 2 is connected to the contact layer 1 through a connection part 3 in a stacked manner.

Furthermore, the support layer 2 is integrally formed by molding, and the contact layer 1 is integrally formed by molding. When the contact layer 1 is integrally formed by molding, at least one part of the contact layer 1 covers a surface of the support layer 2 to form the connection part.

Through the above structure, due to the integrally molded design of the support layer 2 and the contact layer 1, the complexity of the production process is reduced, the structural strength and service life of the pillow core main body 10 are improved, and the integrity and comfort of the pillow core main body 10 are ensured. By integral molding, the contact layer 1 partially covers the support layer 2 to form the connection part, enhancing a bonding force between the contact layer 1 and the support layer 2, ensuring a tight connection between the two layers, avoiding possible separation during long-term use, and ensuring the stability of the pillow core main body 10.

In this embodiment, the support layer 2 is provided with a first top surface 21, a first bottom surface 22, and a peripheral side surface 23. The first top surface 21 and the first bottom surface 22 are disposed opposite to each other, and the peripheral side surface 23 is connected to the first top surface 21 and the first bottom surface 22. When the contact layer 1 is integrally formed by molding, the contact layer 1 covers the first top surface 21 and the peripheral side surface 23. Through the above structure, since the contact layer 1 covers the first top surface 21 and the peripheral side surface 23 of the support layer 2, the support layer 2 is positioned at a bottom portion of the contact layer 1 in an embedded form, providing the bottom portion of the pillow core main body 10 with a strong support. When the pillow core main body 10 is placed on a flexible mattress, the pillow core main body 10 will not collapse under the action of the support layer 2. Moreover, since the contact layer 1 wraps both the first top surface and the peripheral side surface 23 of the support layer 2, when the pillow core main body 10 is placed on the mattress, all surfaces that can be contacted can feel soft support, providing a more comprehensive comfortable experience.

In another embodiment, the support layer 2 is provided with a first top surface 21, a first bottom surface 22, and a peripheral side surface 23. The first top surface 21 and the first bottom surface 22 are disposed opposite to each other. The peripheral side surface 23 is connected to the first top surface 21 and the first bottom surface 22. When the contact layer 1 is integrally formed by molding, the contact layer 1 covers the first top surface 21. Through the above structure, the contact layer 1 covers the first top surface 21 of the support layer 2, and the support layer 2 plays a supporting role. The user's head can also come into contact with the flexible contact layer 1, allowing the pillow to better adapt to the shape of the head and neck, further enhancing the sleep experience.

In this embodiment, a melting point of the support layer 2 is greater than a melting point of the contact layer 1. Through the above structure, since the contact layer 1 is further formed by molding after the support layer 2 is solidified and formed, the melting point of the support layer 2 must be greater than the melting point of the contact layer 1, allowing the support layer 2 to maintain its formed shape and strength during the molding of the contact layer 1, ensuring the stability of the two layers of materials during the production process.

In this embodiment, a density of the contact layer 1 is greater than a density of the support layer 2. Specifically, a density range of the contact layer 1 is 70-90 D. A density range of the support layer 2 is 50-70 D.

Preferably, a density value of the contact layer 1 is 80D, and a density value of the support layer 2 is 60D. Moreover, both the contact layer 1 and the support layer 2 are made of memory foam. Through the above structure, since the contact layer 1 is a surface layer in direct contact with the user, the greater the density, the stronger the flexibility and comfort of the memory foam. Therefore, the density of the contact layer 1 is greater than the density of the support layer 2, providing a softer contact surface for the user. Moreover, the greater the density of the memory foam, the higher the production cost. Reasonably allocating the different material densities of the contact layer 1 and the support layer 2 reduces the production cost while ensuring product effectiveness.

In this embodiment, a first height H2 is provided between the first top surface 21 and the first bottom surface 22. The pillow core main body 10 is provided with a second top surface 101 and a second bottom surface 102. The second top surface 101 and the second bottom surface 102 are arranged opposite to each other. A second height H1 is provided between the first top surface 21 and the second top surface 101, and the second height H1 is greater than the first height H2. Through the above structure, a height of the contact layer 1 is greater than a height of the support layer 2, ensuring that the pillow core main body 10 has sufficient softness and comfort.

In this embodiment, a range of the first height H2 between the first top surface 21 and the first bottom surface 22 is 0.1-20 mm. A range of a third height H3 between the second top surface 101 and the second bottom surface 102 is 120-140 mm.

Preferably, a length value of the pillow core main body 10 is 622.11 mm, a width value of the pillow core main body 10 is 397.34 mm, and a height value of the pillow core main body 10 is 131.53 mm. A length value of the support layer 2 is 470 mm, a width value of the support layer 2 is 273 mm, and a height value of the support layer 2 is 10 mm.

In this embodiment, Brinell hardness test is performed on the pillow core main body 10: when a force of 2.700 kgf is applied to the pillow core main body 10, a deformation of the pillow core main body 10 is 25%; when a force of 3.520 kgf is applied to the pillow core main body 10, the deformation of the pillow core main body 10 is 40%; and when a force of 5.060 kgf is applied to the pillow core main body 10, the deformation of the pillow core main body 10 is 65%.

Furthermore, a ratio of a force value at which the pillow core main body 10 is compressed to 25% of an original thickness thereof to a force value at which the pillow core main body 10 is compressed to 40% of the original thickness is 0.767. A ratio of a force value at which the pillow core main body 10 is compressed to 65% of the original thickness to a force value at which the pillow core main body 10 is compressed to 40% of the original thickness is 1.437.

Through the above structure, the deformation of the pillow core main body 10 under different pressures can be confirmed by the Brinell hardness test results, providing reliable data support for the durability and comfort of the product, ensuring that the pillow can provide good cushioning effect while maintaining support force, and an appropriate ratio of force values enables the pillow core main body 10 to provide stable support effect at different compression depths.

In this embodiment, the pillow core main body 10 is provided with a second top surface 101 and a second bottom surface 102. The second top surface 101 and the second bottom surface 102 are arranged opposite to each other. A middle portion of the second top surface 101 is provided with a first arc-shaped depression 103 that is recessed from the first top surface 21 towards the second bottom surface 102. Through the above structure, the first arc-shaped depression 103 helps to better fit a contour of the user's head, provide a more fitting support, and improve the user experience of the pillow.

In this embodiment, the pillow core main body 10 is equipped with a front side surface 104, a rear side surface 105, a left side surface 106 and a right side surface 107. The front side surface 104 and the rear side surface 105 are connected to the second top surface 101 and the second bottom surface 102, and are arranged opposite to each other. The left side surface 106 and the right side surface 107 are connected to the front side surface 104 and the rear side surface 105, and are arranged opposite to each other. One end of the pillow core main body 10 near the front side surface 104 is protruded with a first side pillow part 110 and a second side pillow part 120. The first side pillow part 110 and the second side pillow part 120 are symmetrically arranged at a left end and a right end of the pillow core main body 10. Through the above structure, the design of the first side pillow part and the second side pillow part 120 makes it easier for the user to avoid falling off the pillow when turning over during sleep. Regardless of whether the user turns over to the left or right to sleep, the pillow core main body 10 will not detach. Compared with existing pillows that require adjusting a position of the pillow when the user turns over, the design of the two side pillow parts in this embodiment greatly improves the convenience and practicality for the user.

In this embodiment, the first side pillow part 110 and the second side pillow part 120 surround and form a recessed neck receiving groove 130. A maximum depth range D1 of the neck receiving groove 130 is 40-60 mm. Preferably, a maximum depth value of the neck receiving groove 130 is 55.23 mm. Through the above structure, the design of the neck receiving groove 130 ensures that the neck can be comfortably embedded therein, providing a more snug support, conforming to ergonomic design and enhancing the pillow's user experience.

In this embodiment, the pillow further includes a pillowcase 20. The pillowcase 20 is at least partially sleeved on an outer surface of the pillow core main body 10, and a shape of the pillowcase 20 is adapted to the pillow core main body 10. The pillowcase 20 includes a third top surface 201 and a third bottom surface 202. The third top surface 201 and the third bottom surface 202 are arranged opposite to each other. The third bottom surface 202 is provided with a pillowcase opening 203, and the pillowcase 20 can be sleeved on the outer surface of the pillow core main body 10 through the pillowcase opening 203. The pillowcase opening 203 is surrounded by an elastic strap 2031. The elastic strap 2031 is connected to an edge of the pillowcase opening 203. The elastic strap 2031 is configured for shrinking the pillowcase opening 203. Through the above structure, the shape of the pillowcase 20 is adapted to the pillow core main body 10, ensuring a good fit. Due to the arrangement of the pillowcase opening 203, and the pillowcase opening 203 being surrounded by the elastic strap 2031, the user can stretch the elastic strap 2031 to sleeve the pillowcase 20 onto the pillow core main body 10, making it easy to operate and protecting the pillow core main body 10 for easy disassembly and cleaning.

In this embodiment, the pillowcase 20 includes knitted fabric, ice silk fabric, nylon, and spandex. Specifically, the pillowcase 20 is made of 85% nylon and 15% spandex. A length value of the pillowcase 20 is 623.11 mm, a width value of the pillowcase 20 is 398.34 mm, and a height value of the pillowcase 20 is 132.53 mm. Through the above structure, since the pillowcase 20 includes ice silk fabric, the pillowcase 20 brings a cool touch to the user and improves the comfort of the pillow.

Figure 7:
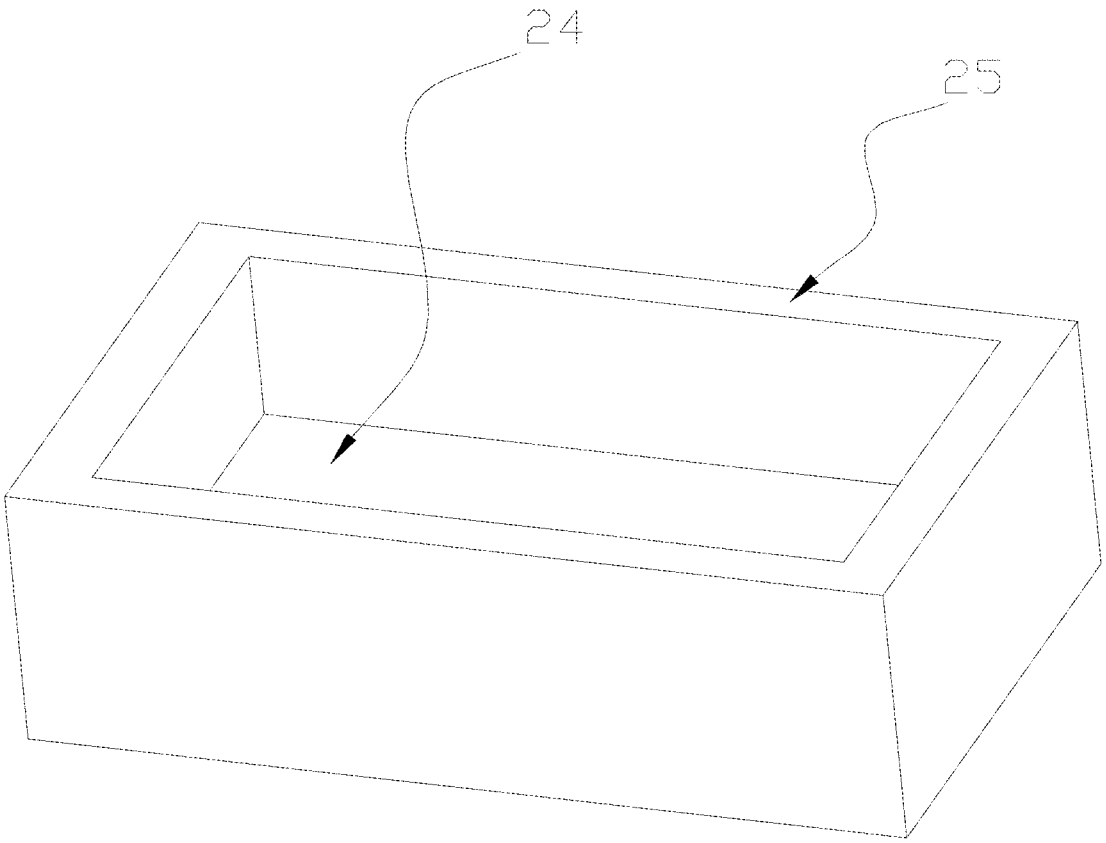
FIG. 7 is a schematic diagram of a first mold in a method for making a pillow of the present invention.
Figure 8:
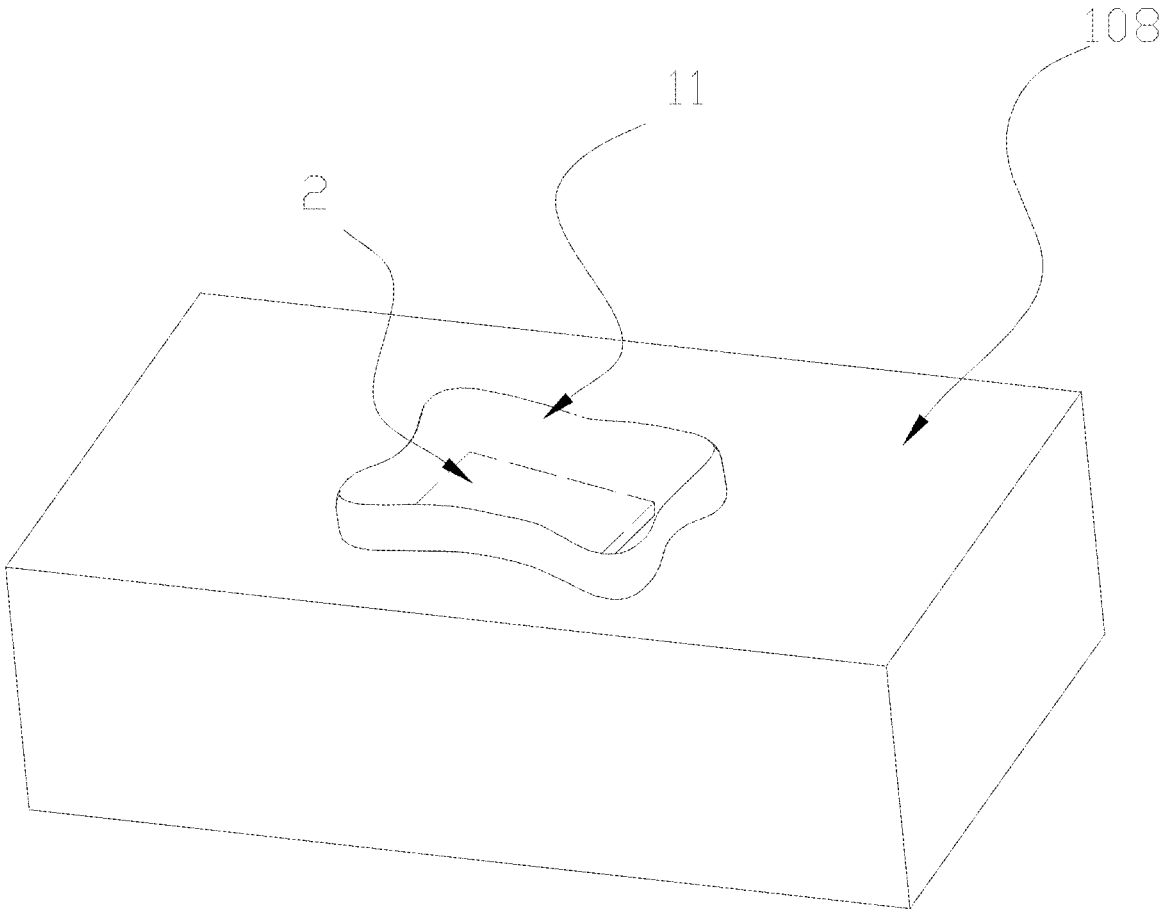
FIG. 8 is a schematic diagram of a second mold in a method for making a pillow of the present invention.

Referring to FIGS. 1-8, a method for making a pillow is further provided, including:

Providing a first molding body 24 and a first mold 25, wherein the first molding body 24 is injected into the first mold 25 and solidified to form a support layer 2;

Providing a second mold 108, wherein the support layer 2 is taken out of the first mold 25 and put into the second mold 108;

Providing a second molding body 11, wherein the second molding body 11 is injected into the second mold 108, at least one part of the second molding body 11 is attached to a surface of the support layer 2 to form an attachment part, the second molding body 11 solidifies to form a contact layer 1, the attachment part solidifies to form a connection part 3, and the contact layer 1 is connected with the support layer 2 through the connection part 3, so that the contact layer 1 wraps the support layer 2;

Removing the contact layer 1 and the support layer 2 from the second mold 108 to obtain the pillow.

Through the above structure, the support layer 2 and the contact layer 1 which are integrally formed are effectively produced, and the tight connection between the contact layer and the support layer 2 is ensured, achieving the integrity and stability of the pillow.

In this embodiment, the support layer 2 is provided with a first top surface 21, a first bottom surface 22, and a peripheral side surface 23. The first top surface 21 and the first bottom surface 22 are arranged opposite to each other. The peripheral side surface 23 is connected to the first top surface 21 and the first bottom surface 22. When the second molding body 11 is injected into the second mold 108, the contact layer 1 covers the first top surface 21 and the peripheral side surface 23. Through the above structure, the contact layer 1 covers the first top surface 21 and the peripheral side surface 23 of the support layer 2 by molding. At this time, the support layer 2 is positioned at a bottom portion of the contact layer 1 in an embedded form, so that the bottom portion of the pillow core main body 10 has strong support. When the pillow core main body 10 is placed on a flexible mattress, the pillow core main body 10 will not collapse under the action of the support layer 2. Moreover, since the contact layer 1 wraps the first top surface 21 and the peripheral side surface 23 of the support layer 2, all surfaces that can be contacted when the pillow core main body 10 is placed on the mattress can feel soft support, providing a more comprehensive comfortable experience.

In another embodiment, the support layer 2 is provided with a first top surface 21, a first bottom surface 22, and a peripheral side surface 23. The first top surface 21 and the first bottom surface 22 are arranged opposite to each other. The peripheral side surface 23 is connected to the first top surface 21 and the first bottom surface 22. When the second molding body 11 is injected into the second mold 108, the second molding body 11 is attached to the first top surface 21. Through the above structure, the contact layer 1 covers the first top surface 21 of the support layer 2 by molding, and the support layer 2 plays a supporting role, so that the user's head can also come into contact with the flexible contact layer 1, and the pillow can better adapt to the shape of the head and neck, further enhancing the sleeping experience.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A pillow, comprising a pillow core main body, the pillow core main body comprising:

a contact layer; and a support layer, wherein the support layer is arranged under the contact layer, and a hardness of the support layer is greater than a hardness of the contact layer;

wherein the support layer is provided with a first top surface, a first bottom surface, and a peripheral side surface; the first top surface and the first bottom surface are disposed opposite to each other, the peripheral side surface is connected to the first top surface and the first bottom surface, and the contact layer covers only the first top surface and the peripheral side surface to form a connection part, with at least part of the first bottom surface being exposed outside the contact layer, wherein a first height is provided between the first top surface and the first bottom surface, the pillow core main body is provided with a second top surface and a second bottom surface, the second top surface and the second bottom surface are arranged opposite to each other, a second height is provided between the first top surface and the second top surface, and the second height is greater than the first height.

2. The pillow according to claim 1, wherein a melting point of the support layer is greater than a melting point of the contact layer.

3. The pillow according to claim 1, wherein a density of the contact layer is greater than a density of the support layer.

4. The pillow according to claim 1, wherein a range of the first height between the first top surface and the first bottom surface is 0.1-20 mm, and a range of a third height between the second top surface and the second bottom surface is 120-140 mm.

5. The pillow according to claim 1, wherein a ratio of a force value at which the pillow core main body is compressed to 25% of an original thickness thereof to a force value at which the pillow core main body is compressed to 40% of the original thickness is 0.767; and a ratio of a force value at which the pillow core main body is compressed to 65% of the original thickness to a force value at which the pillow core main body is compressed to 40% of the original thickness is 1.437.

6. The pillow according to claim 1, wherein the pillow core main body is provided with a second top surface and a second bottom surface, the second top surface and the second bottom surface are arranged opposite to each other, and a middle portion of the second top surface is provided with a first arc-shaped depression that is recessed from the second top surface towards the second bottom surface.

7. The pillow according to claim 6, wherein the pillow core main body is equipped with a front side surface, a rear side surface, a left side surface and a right side surface; the front side surface and the rear side surface are connected to the second top surface and the second bottom surface, and are arranged opposite to each other; the left side surface and the right side surface are connected to the front side surface and the rear side surface, and are arranged opposite to each other; one end of the pillow core main body near the front side surface is protruded with a first side pillow part and a second side pillow part, and the first side pillow part and the second side pillow part are symmetrically arranged at a left end and a right end of the pillow core main body.

8. The pillow according to claim 7, wherein the first side pillow part and the second side pillow part surround and form a recessed neck receiving groove; a maximum depth range of the neck receiving groove is 40-60 mm.

9. The pillow according to claim 1, further comprising a pillowcase, wherein the pillowcase is at least partially sleeved on an outer surface of the pillow core main body, and a shape of the pillowcase is adapted to the pillow core main body; the pillowcase comprises a third top surface and a third bottom surface, the third top surface and the third bottom surface are arranged opposite to each other, the third bottom surface is provided with a pillowcase opening, and the pillowcase can be sleeved on the outer surface of the pillow core main body through the pillowcase opening; the pillowcase opening is surrounded by an elastic strap, the elastic strap is connected to an edge of the pillowcase opening, and the elastic strap is configured for shrinking the pillowcase opening.

10. The pillow according to claim 9, wherein the pillowcase comprises nylon, and spandex.

11. A pillow, comprising:

a pillow core main body comprising:

a contact layer; and a support layer, wherein the contact layer is formed on the support layer, with a hardness of the support layer being greater than a hardness of the contact layer, and the support layer is provided with a first top surface, a first bottom surface, and a peripheral side surface; the first top surface and the first bottom surface are disposed opposite to each other, the peripheral side surface is connected to the first top surface and the first bottom surface, and the contact layer is integrally formed with the support layer by insert molding, and the contact layer is connected to the support layer only at the first top surface and the peripheral side surface, with the first bottom surface of the support layer being exposed outside the contact layer; and a pillowcase, wherein the pillowcase is at least partially sleeved on an outer surface of the pillow core main body, and a shape of the pillowcase is adapted to the pillow core main body; the pillowcase comprises a third top surface and a third bottom surface, the third top surface and the third bottom surface are arranged opposite to each other, the third bottom surface is provided with a pillowcase opening, and the pillowcase can be sleeved on the outer surface of the pillow core main body through the pillowcase opening; the pillowcase opening is surrounded by an elastic strap, the elastic strap is connected to an edge of the pillowcase opening, and the elastic strap is configured for shrinking the pillowcase opening, wherein a first height is provided between the first top surface and the first bottom surface, the pillow core main body is provided with a second top surface and a second bottom surface, the second top surface and the second bottom surface are arranged opposite to each other, a second height is provided between the first top surface and the second top surface, and the second height is greater than the first height.

* * * * *